US010087391B2

(12) United States Patent
Waynick

(10) Patent No.: US 10,087,391 B2
(45) Date of Patent: Oct. 2, 2018

(54) COMPOSITION AND METHOD OF MANUFACTURING CALCIUM MAGNESIUM SULFONATE GREASES WITHOUT A CONVENTIONAL NON-AQUEOUS CONVERTING AGENT

(71) Applicant: NCH Corporation, Irving, TX (US)

(72) Inventor: J. Andrew Waynick, Lantana, TX (US)

(73) Assignee: NCH CORPORATION, Irving, TX (US)

( * ) Notice: Subject to any disclaimer, the term of this patent is extended or adjusted under 35 U.S.C. 154(b) by 0 days.

(21) Appl. No.: 15/593,912

(22) Filed: May 12, 2017

(65) Prior Publication Data

US 2017/0335229 A1 Nov. 23, 2017

Related U.S. Application Data

(60) Provisional application No. 62/338,193, filed on May 18, 2016.

(51) Int. Cl.

| | |
|---|---|
| ***C10M 159/24*** | (2006.01) |
| ***C10M 159/20*** | (2006.01) |
| ***C10M 177/00*** | (2006.01) |
| ***C10M 115/10*** | (2006.01) |

(52) U.S. Cl.

CPC ..... *C10M 159/24* (2013.01); *C10M 115/10* (2013.01); *C10M 159/20* (2013.01); *C10M 177/00* (2013.01); *C10M 2203/1006* (2013.01); *C10M 2203/1025* (2013.01); *C10M 2211/08* (2013.01); *C10M 2219/0466* (2013.01); *C10N 2210/02* (2013.01); *C10N 2230/06* (2013.01); *C10N 2240/406* (2013.01); *C10N 2250/10* (2013.01)

(58) Field of Classification Search

CPC ..... C10N 2270/00; C10N 2230/52; C10N 2230/06; C10N 2220/082; C10N 2220/022; C10N 2250/10; C10N 2210/02; C10N 2210/01; C10M 2219/046

USPC ..... 508/391

See application file for complete search history.

(56) References Cited

U.S. PATENT DOCUMENTS

| | | | | |
|---|---|---|---|---|
| 2,270,577 | A | | 1/1942 | Bergstrom |
| 2,402,325 | A | | 6/1946 | Griesinger |
| 2,418,894 | A | | 4/1947 | McNab |
| 2,444,970 | A | | 7/1948 | Zimmer |
| 2,485,861 | A | | 10/1949 | Campbell |
| 2,501,731 | A | | 3/1950 | Mertes |
| 2,535,101 | A | | 12/1950 | Sproule |
| 2,540,533 | A | | 2/1951 | Kolfenbach |
| 2,585,520 | A | | 2/1952 | Van Ess |
| 2,616,904 | A | | 11/1952 | Asseff |
| 2,616,905 | A | | 11/1952 | Asseff |
| 2,616,906 | A | | 11/1952 | Asseff |
| 2,616,911 | A | | 11/1952 | Asseff |
| 2,616,924 | A | | 11/1952 | Asseff |
| 2,616,925 | A | | 11/1952 | Asseff |
| 2,617,049 | A | | 11/1952 | Asseff |
| 2,695,910 | A | | 11/1954 | Asseff |
| 2,723,235 | A | | 11/1955 | Asseff |
| 2,839,470 | A | | 6/1958 | Warren |
| 2,861,951 | A | | 11/1958 | Carlyle |
| 2,865,956 | A | | 12/1958 | Ellis |
| 2,898,296 | A | | 8/1959 | Pattenden et al. |
| 2,920,105 | A | | 1/1960 | Kluge |
| 2,937,991 | A | | 5/1960 | Carlyle |
| 2,940,930 | A | | 6/1960 | Pattenden et al. |
| 2,956,018 | A | | 10/1960 | Carlyle |
| 2,967,151 | A | | 1/1961 | Morway |
| 2,977,301 | A | | 3/1961 | Bergen |
| 2,978,410 | A | | 4/1961 | Fullerton |
| 3,027,325 | A | | 3/1962 | McMillen |
| 3,057,896 | A | | 10/1962 | Schlight et al. |
| 3,150,088 | A | | 9/1964 | Hunt et al. |
| 3,186,944 | A | | 6/1965 | Dreher |
| 3,242,079 | A | | 3/1966 | McMillen |
| 3,372,115 | A | | 3/1968 | McMillen |
| 3,376,222 | A | | 4/1968 | McMillen |
| 3,377,283 | A | | 4/1968 | McMillen |
| 3,492,231 | A | | 1/1970 | McMillen |
| 3,537,996 | A | | 11/1970 | Holst |
| 3,629,109 | A | * | 12/1971 | Karn et al. ..... C07C 51/414 44/373 |
| 3,655,558 | A | | 4/1972 | Geyer et al. |
| 3,661,622 | A | | 5/1972 | Rogers |
| 3,671,012 | A | | 6/1972 | Scott |
| 3,679,584 | A | | 7/1972 | Hellmuth |
| 3,681,242 | A | | 8/1972 | Gilani et al. |
| 3,746,643 | A | | 7/1973 | Rogers |
| 3,791,973 | A | | 2/1974 | Gilani et al. |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2).

(Continued)

*Primary Examiner* — Vishal V Vasisth

(74) *Attorney, Agent, or Firm* — Ross Barnes LLP; Robin L. Barnes

(57) ABSTRACT

An overbased calcium magnesium sulfonate grease composition and method of making such grease without using any conventional non-aqueous converting agents, such as hexylene glycol, as a pre-conversion ingredient. The addition of magnesium sulfonate as an ingredient prior to conversion appears to act as a new, non-conventional converting agent, resulting in greases with improved thickener yield and excellent dropping point.

35 Claims, No Drawings

(56) References Cited

U.S. PATENT DOCUMENTS

| | | | |
|---|---|---|---|
| 3,816,310 | A | 6/1974 | Hunt |
| 3,850,823 | A | 11/1974 | Kjonaas |
| 3,907,691 | A | 9/1975 | King et al. |
| 3,929,650 | A | 12/1975 | King et al. |
| 3,940,339 | A | 2/1976 | Clarke, Jr. et al. |
| 4,297,227 | A | 10/1981 | Witte et al. |
| 4,376,060 | A | 3/1983 | Stadler |
| 4,435,299 | A | 3/1984 | Carley et al. |
| 4,444,669 | A | 4/1984 | Wittse, Jr. et al. |
| 4,483,775 | A | 11/1984 | Yamaguchi |
| 4,560,489 | A | 12/1985 | Muir |
| 4,597,880 | A | 7/1986 | Eliades |
| 4,728,578 | A | 3/1988 | Higgins et al. |
| 4,744,920 | A | 5/1988 | Fischer et al. |
| 4,780,224 | A | 10/1988 | Jao |
| 4,787,992 | A | 11/1988 | Waynick |
| 4,810,396 | A | 3/1989 | Jao et al. |
| 4,810,398 | A | 3/1989 | Van Kruchten et al. |
| 4,824,584 | A | 4/1989 | Muir |
| 4,830,767 | A | 5/1989 | Waynick |
| 4,902,435 | A | 2/1990 | Waynick |
| 4,904,399 | A | 2/1990 | Waynick |
| 4,929,371 | A | 5/1990 | Waynick |
| 5,084,193 | A | 1/1992 | Waynick |
| 5,126,062 | A | 6/1992 | Barnes |
| 5,190,678 | A | 3/1993 | Swartz |
| 5,308,514 | A | 5/1994 | Olson |
| 5,338,467 | A | 8/1994 | Olson et al. |
| 6,172,122 | B1 | 1/2001 | Lawate et al. |
| 6,239,083 | B1 | 5/2001 | Muir |
| 6,432,889 | B1 | 8/2002 | Kinoshita et al. |
| 6,596,672 | B1 | 7/2003 | Carrick et al. |
| 6,869,111 | B2 | 3/2005 | Goto et al. |
| 6,875,731 | B1 | 4/2005 | Bence |
| 7,241,723 | B2 | 7/2007 | Zhang |
| 7,294,608 | B2 | 11/2007 | Oldiges |
| 7,517,837 | B2 | 4/2009 | Kurosky et al. |
| 9,273,265 | B2 | 3/2016 | Waynick |
| 9,458,406 | B2 | 10/2016 | Waynick |
| 2003/0111838 | A1 | 6/2003 | Goto et al. |
| 2005/0054541 | A1 | 3/2005 | Zhang et al. |
| 2005/0215442 | A1 | 9/2005 | Sivik et al. |
| 2006/0025317 | A1 | 2/2006 | Olson et al. |
| 2006/0223719 | A1 | 10/2006 | Riff et al. |
| 2007/0060485 | A1 | 3/2007 | Waynick |
| 2009/0305920 | A1 | 12/2009 | Kato et al. |
| 2011/0021391 | A1 | 1/2011 | E et al. |
| 2011/0048809 | A1 | 3/2011 | Duckworth |
| 2011/0092404 | A1 | 4/2011 | Zhang et al. |
| 2011/0136709 | A1 | 6/2011 | Tanaka et al. |
| 2011/0160105 | A1 | 6/2011 | Tanaka et al. |
| 2011/0190177 | A1 | 8/2011 | Zaki |
| 2011/0195880 | A1 | 8/2011 | Kawamura et al. |
| 2011/0233473 | A1 | 9/2011 | Fletcher |
| 2013/0109602 | A1 | 5/2013 | Waynick |
| 2014/0121139 | A1 | 5/2014 | Waynick |
| 2016/0115416 | A1 | 4/2016 | Waynick |

FOREIGN PATENT DOCUMENTS

| | | |
|---|---|---|
| CN | 102051257 | 5/2011 |
| CN | 102634400 | 8/2012 |
| CN | 103952215 | 7/2014 |
| GB | 816318 | 7/1959 |
| GB | 1239860 | 7/1971 |
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| WO | WO2011098616 | 8/2011 |

OTHER PUBLICATIONS

Boner, C.J. Manufacture and Application of Lubricating Greases, 1954, p. 369, Hafner Publishing Company, Inc.

* cited by examiner

COMPOSITION AND METHOD OF MANUFACTURING CALCIUM MAGNESIUM SULFONATE GREASES WITHOUT A CONVENTIONAL NON-AQUEOUS CONVERTING AGENT

CROSS-REFERENCE TO RELATED APPLICATION

This application claims the benefit of U.S. provisional patent application No. 62/338,193 filed May 18, 2016.

BACKGROUND OF THE INVENTION

1. Field of the Invention

This invention relates to overbased calcium magnesium sulfonate greases made without any conventional non-aqueous converting agents to produce a sulfonate-based grease with a high dropping point and good thickener yield. This invention also relates to such greases made without a convention non-aqueous converting agent in combination with one or more of the following methods or ingredients: (1) the addition of calcium hydroxyapatite and/or added crystalline calcium carbonate as calcium-containing bases for reacting with complexing acids; (2) the addition of an alkali metal hydroxide; (3) the delayed addition of magnesium sulfonate; (4) a split addition of magnesium sulfonate; or (5) a delay between the addition of a facilitating acid and the next subsequent ingredient.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases.

Typically the second step ("conversion") is to add a converting agent or agents to the product of the promotion step, along with a suitable base oil (such as mineral oil) if needed to keep the initial grease from being too hard, to convert the amorphous calcium carbonate contained in the overbased calcium sulfonate to a very finely divided dispersion of crystalline calcium carbonate (calcite). Prior art converting agents include water and non-aqueous converting agents, such as propylene glycol, iso-propyl alcohol, formic acid or acetic acid. When acetic acid or other acids are used as a converting agent, typically water and another non-aqueous converting agent (a third converting agent, such as an alcohol) are also used; alternatively only water (without the third converting agent) is added, but the conversion then typically occurs in a pressurized vessel.

Because an excess of calcium hydroxide or calcium oxide is used to achieve overbasing, a small amount of residual calcium oxide or calcium hydroxide may also be present as part of the oil soluble overbased calcium sulfonate and will be dispersed in the initial grease structure. The extremely finely divided calcium carbonate formed by conversion, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

In addition to simple calcium sulfonate greases, calcium sulfonate complex greases are also known in the prior art. These complex greases are typically produced by adding a strong calcium-containing base, such as calcium hydroxide or calcium oxide, to the simple calcium sulfonate grease produced by either the two-step or one-step process and reacting with up to stoichiometrically equivalent amounts of complexing acids, such as 12-hydroxystearic acid, boric acid, acetic acid (which may also be a converting agent when added pre-conversion), or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467.

Additionally, it is desirable to have a calcium sulfonate complex grease composition and method of manufacture that results in both improved thickener yield (by requiring a smaller percentage of overbased calcium sulfonate in the final grease) and dropping point. The term "thickener yield" as used herein refers to the concentration of the highly overbased oil-soluble calcium sulfonate required to provide a grease with a specific desired consistency as measured by the standard penetration tests ASTM D217 or D1403 commonly used in lubricating grease manufacturing. The term "dropping point" as used herein refers to the value obtained by using the standard dropping point test ASTM D2265 commonly used in lubricating grease manufacturing. Many of the known prior art compositions and methodologies require an amount of overbased calcium sulfonate of least 36% (by weight of the final grease product) to achieve a suitable grease in the NLGI No. 2 category with a demonstrated dropping point of at least 575 F. The overbased oil-soluble calcium sulfonate is one of the most expensive ingredients in making calcium sulfonate grease. Therefore it is desirable to reduce the amount of this ingredient while still maintaining a desirable level of firmness in the final grease (thereby improving thickener yield).

There are several known compositions and methods that result in improved thickener yield while maintaining a sufficiently high dropping point. For example, in order to achieve a substantial reduction in the amount of overbased calcium sulfonate used, many prior art references utilize a pressure reactor. It is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295), without requiring a pressure reactor. Higher dropping points are considered desirable since the dropping point is the first and most easily determined guide as to the high temperature utility limitations of a lubricating grease.

Overbased calcium sulfonate greases requiring less than 36% overbased calcium sulfonate are also achieved using the compositions and methods described in U.S. Pat. Nos. 9,273,265 and 9,458,406. The '265 and '406 patents teach the use of added crystalline calcium carbonate and/or added calcium hydroxyapatite (either with or without added calcium hydroxide or calcium oxide) as calcium-containing bases for reaction with complexing acids in making complex overbased calcium sulfonate greases. Prior to these patents, the known prior art always taught the use of calcium oxide or calcium hydroxide as the sources of basic calcium for production of calcium sulfonate greases or as a required component for reacting with complexing acids to form calcium sulfonate complex greases. The known prior art also taught that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. The known prior art also generally taught that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate is generally considered to be a weak base, unsuitable for reacting with complexing acids to form optimum grease structures. The second being that the presence of unreacted solid calcium compounds (including calcium carbonate, calcium hydroxide or calcium oxide) interferes with the conversion process, resulting in inferior greases if the unreacted solids are not removed prior to conversion or before conversion is completed. However, as described in the '265 and '406 patents, Applicant has found that the addition of calcium carbonate as a separate ingredient (in addition to the amount of calcium carbonate contained in the overbased calcium sulfonate), calcium hydroxyapatite, or a combination thereof, either with or without added calcium hydroxide or calcium oxide, as ingredients for reacting with complexing acids produces a superior grease In addition to the '265 and '406 patents, there are a couple of prior art references that disclose the addition of crystalline calcium carbonate as a separate ingredient (in addition to the amount of calcium carbonate contained in the overbased calcium sulfonate), but those greases have poor thickener yield (as the prior art teaches) or require nano-sized particles of calcium carbonate. For example, U.S. Pat. No. 5,126,062 discloses the addition of 5-15% calcium carbonate as a separate ingredient in forming a complex grease, but also requires the addition of calcium hydroxide to react with complexing acids. The added calcium carbonate is not the sole added calcium containing base for reacting with complexing acids in the '062 patent. In fact, the added calcium carbonate is specifically not added as a basic reactant for reaction with complexing acids. Instead, added calcium hydroxide is required as the specific calcium-containing base for reaction with all the complexing acids. Additionally, the resulting NLGI No. 2 grease contains 36%-47.4% overbased calcium sulfonate, which is a substantial amount of this expensive ingredient. In another example, Chinese publication CN101993767, discloses the addition of nano-sized particles of calcium carbonate (sized between 5-300 nm) being added to the overbased calcium sulfonate, although the reference does not indicate that the nano-sized particles of calcium carbonate are added as a reactant, or the sole separately added calcium containing base, for reacting with complexing acids. The use of nano-sized particles would add to the thickening of the grease to keep it firm, much like the fine dispersion of crystalline calcium carbonate formed by converting the amorphous calcium carbonate contained within the overbased calcium sulfonate (which can be around 20 A to 5000 A or around 2 nm to 500 nm according to the '467 patent), but would also substantially increase the costs over larger sized particles of added calcium carbonate. This Chinese patent application greatly emphasizes the absolute necessity of the added calcium carbonate having a true nano particle size. As shown in the example greases according to the invention described in U.S. Pat. No. 9,273,265, superior greases may be formed by the addition of micron sized calcium carbonate without requiring the use of the very expensive nano-sized particles when using added calcium carbonate as one of or the sole added calcium containing base for reacting with complexing acids.

There are also prior art references for using tricalcium phosphate as an additive in lubricating greases. For instance, U.S. Pat. Nos. 4,787,992; 4,830,767; 4,902,435; 4,904,399; and 4,929,371 all teach using tricalcium phosphate as an additive for lubricating greases. However, it is believed that prior to the '406 patent, no prior art references taught the use of calcium hydroxyapatite, having the formula $Ca_5(PO_4)_3OH$ or a mathematically equivalent formula with a melting point of around 1100 C, as a calcium-containing base for reaction with acids to make lubricating greases, including calcium sulfonate-based greases. There are several prior art references assigned to Showa Shell Sekiyu in Japan, including U.S. Patent Application Publication No. 2009/0305920, that describe greases containing tricalcium phosphate, $Ca_3(PO_4)_2$, and reference a "hydroxyapatite" having the formula $[Ca_3(PO_4)_2]_3.Ca(OH)_2$ as a source of tricalcium phosphate. This reference to "hydroxyapatite" is disclosed as a mixture of tricalcium phosphate and calcium hydroxide, which is not the same as the calcium hydroxyapatite disclosed and claimed in the '406 patent and herein having the formula $Ca_5(PO_4)_3OH$ or a mathematically equivalent formula with a melting point of around 1100 C. Despite the misleading nomenclature, calcium hydroxyapatite, tricalcium phosphate, and calcium hydroxide are each distinct chemical compounds with different chemical formulae, structures, and melting points. When mixed together, the two distinct crystalline compounds tricalcium phosphate ($Ca_3(PO_4)_2$) and calcium hydroxide ($Ca(OH)_2$) will not react with each other or otherwise produce the different crystalline compound calcium hydroxyapatite ($Ca_5(PO_4)_3OH$). The melting point of tricalcium phosphate (having the formula $Ca_3(PO_4)_2$) is 1670 C. Calcium hydroxide does not have a melting point, but instead loses a water molecule to form calcium oxide at 580 C. The calcium oxide thus formed has a melting point of 2580 C. Calcium hydroxyapatite (having the formula $Ca_5(PO_4)_3OH$ or a mathematically equivalent formula) has a melting point of around 1100 C. Therefore, regardless of how inaccurate the nomenclature may be, calcium hydroxyapatite is not the same chemical compound as tricalcium phosphate, and it is not a simple blend of tricalcium phosphate and calcium hydroxide.

The addition of alkali metal hydroxides in simple calcium soap greases, such as anhydrous calcium-soap thickened greases, is also known. But prior to the disclosure in U.S. application Ser. No. 15/130,422, it was not known to add an alkali metal hydroxide in a calcium sulfonate grease to provide improved thickener yield and high dropping point, because that addition would be considered unnecessary by one of ordinary skill in the art. The reason for adding an alkali metal hydroxide, such as sodium hydroxide, in simple calcium soap greases is that the usually used calcium hydroxide has poor water solubility and is a weaker base than the highly water soluble sodium hydroxide. Because of this, the small amount of sodium hydroxide dissolved in the added water is said to react quickly with the soap forming fatty acid (usually 12-hydroxystearic acid or a mixture of 12-hydroxystearic acid and a non-hydroxylated fatty acid such as oleic acid) to form the sodium soap. This quick reaction is thought to "get the ball rolling." However, the direct reaction of calcium-containing bases such as calcium hydroxide with fatty acids has never been a problem when making calcium sulfonate complex greases. The reaction occurs very easily, likely due to the high detergency/dispersancy of the large amount of calcium sulfonate present. As such, it is not known in the prior art to use an alkali metal hydroxide in a calcium sulfonate grease as a way to get the complexing acids to react with the calcium hydroxide.

It has not previously been known to make a calcium magnesium sulfonate grease without a conventional non-aqueous converting agent. It is also not known to combine various ingredients and methodologies in making a sulfonate-based grease with improved thickener yield and high dropping, such as combining omission of a conventional non-aqueous converting agent with (1) a split addition of magnesium sulfonate method or a delayed addition of magnesium sulfonate method or a combination of a split addition and delayed addition method; (2) the use of calcium hydroxyapatite, added crystalline calcium carbonate, or a combination thereof (without or without added calcium hydroxide or calcium oxide) as calcium containing bases (also referred to as basic calcium compounds) for reaction with complexing acids; (3) addition of an alkali metal hydroxide; (4) a facilitating acid delay; or (5) a combination of these methods and ingredients.

SUMMARY OF THE INVENTION

This invention relates to calcium magnesium sulfonate greases and methods for manufacturing such greases without adding a conventional non-aqueous converting agent prior to conversion to provide improvements in both thickener yield (requiring less overbased calcium sulfonate while maintaining acceptable penetration measurements) and expected high temperature utility as demonstrated by dropping point. As used herein, a calcium sulfonate grease (or overbased calcium sulfonate grease) containing overbased magnesium sulfonate is sometimes referred to as a calcium magnesium sulfonate grease, an overbased calcium magnesium sulfonate grease, or a sulfonate-based grease. As used herein, "conventional non-aqueous converting agents" refers to converting agents (other than water) that solely function as converting agents (rather than dual role complexing acids-converting agents) and are added to the composition prior to conversion. Such conventional non-aqueous converting agents may contain some water as a diluent or an impurity. Examples of conventional non-aqueous converting agents include alcohols, ethers, glycols, glycol ethers, glycol polyethers, and other polyhydric alcohols and their derivatives that are added prior to conversion. Such ingredients may be added after conversion, if desired, within the scope of various embodiments of the invention since they would not be acting as converting agents after conversion is complete and would not be considered "conventional non-aqueous converting agents" in that case.

According to one preferred embodiment, a sulfonate-based grease is made by mixing overbased calcium sulfonate, overbased magnesium sulfonate, an optional base oil, and water as a converting agent, without the pre-conversion addition of any conventional non-aqueous converting agents (such a hexylene glycol). The magnesium sulfonate may be added all at once, using a split addition method, a magnesium sulfonate delay addition method, or a combination of a split addition and delayed addition method (as further described in co-pending U.S. application Ser. No. 15/593,792, which is incorporated herein by reference). Without being bound by theory, it appears that the magnesium sulfonate acts as a converting agent. Since magnesium sulfonate has not previously been known to be used as a converting agent, it is sometimes referred to herein as a "non-conventional" converting agent.

According to another preferred embodiment, if a complex grease is desired, one or more complexing acids are also added, either before conversion, after conversion, or both. Some complexing acids are known to also act as converting agents when added prior to conversion. Dual role converting agent-complexing acids are not considered to be conventional non-aqueous converting agents herein and may be added prior to conversion according to various embodiments of the invention, provided that magnesium sulfonate is also added and no conventional non-aqueous converting agents are added.

According to another preferred embodiment, improved thickener yield and sufficiently high dropping points are achieved when conventional non-aqueous converting agents are omitted, even when the overbased calcium sulfonate is considered to be of "poor" quality as described and defined in the '406 patent. According to other preferred embodiments, a sulfonate-based grease is made without adding any conventional non-aqueous converting agents prior to conversion in combination with one or more of the following ingredients or methods: (1) the addition of calcium hydroxyapatite and/or added calcium carbonate as calcium-containing bases for reacting with complexing acids, either with or without separately adding added calcium hydroxide and/or added calcium oxide as calcium containing bases; (2) the addition of an alkali metal hydroxide (most preferably lithium hydroxide); or (3) a facilitating acid delay. These additional methods and ingredients are disclosed in U.S. patent application Ser. No. 13/664,768 (now U.S. Pat. No. 9,458,406), Ser. No. 13/664,574 (now U.S. Pat. No. 9,273,265), Ser. Nos. 15/130,422, 15/593,792, and 15/593,839, which are incorporated herein by reference. For ease of reference, a delay with respect to the addition of overbased magnesium sulfonate as described in the '792 application will be referred to as a magnesium sulfonate delay period or magnesium sulfonate delay method (or similar wording);

and a delay with respect to a facilitating acid as described in the '839 application will be referred to as a facilitating acid delay period or facilitating acid delay method (or similar wording).

DESCRIPTION OF THE PREFERRED EMBODIMENTS

Sulfonate-Based Grease Compositions

According to one preferred embodiment of the invention, a calcium magnesium sulfonate grease composition is provided comprising overbased calcium sulfonate, overbased magnesium sulfonate, water as a converting agent, and no conventional non-aqueous converting agents are added as ingredients to the composition. In other words, water, magnesium sulfonate, and optionally any dual role complexing acid-converting agents are the only converting agent ingredients added to the composition. According to another preferred embodiment, a calcium magnesium sulfonate simple or complex grease composition further comprises base oil, one or more added calcium containing bases, and optionally a facilitating acid. According to another preferred embodiment, a calcium magnesium sulfonate complex grease composition further comprises one or more complexing acids.

According to several preferred embodiments, a calcium sulfonate grease composition or a calcium magnesium sulfonate grease composition comprises the following ingredients by weight percent of the final grease product (although some ingredients, such as water, acids, and calcium containing bases, may not be in the final grease product or may not be in the concentrations indicated for addition):

TABLE 1

| Preferred Compositions | | | |
|---|---|---|---|
| Ingredient | Preferred Amount (%) | More Preferred Amount (%) | Most Preferred Amount (%) |
| Overbased Calcium Sulfonate | 10%-45% | 10%-36% | 10%-22% |
| Overbased Magnesium Sulfonate | 0.1%-30 | 1%-24% | 1%-15% |
| Added Base Oil | 30%-70% | 45%-70% | 50%-70% |
| Total Added Calcium Containing Bases (Optional for a Simple Grease) | 2.7%-41.2% | 4.15% to 31% | 6.18% to 20.8% |
| Water (as a Converting Agent) | 1.5%-10% | 2.0%-5.0% | 2.2%-4.5% |
| Facilitating Acid | 0.5%-5.0% | 1.0%-4.0% | 1.3%-3.6% |
| Alkali Metal Hydroxide (Optional) | 0.005% to 0.5% | 0.01% to 0.4% | 0.02% to 0.2% |
| Total Complexing Acids (if complex grease is desired) | 1.25%-18% | 2.2-12% | 3.55%-8.5% |

Some or all of any particular ingredient, including converting agents and added calcium containing bases, may not be in the final finished product due to evaporation, volatilization, or reaction with other ingredients during manufacture. These amounts are when a grease is made in an open vessel. Even smaller amounts of overbased calcium sulfonate may be used when a calcium magnesium sulfonate grease is made in a pressure vessel.

According to another preferred embodiment, a calcium magnesium sulfonate grease comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20. According to another preferred embodiment, a pre-conversion sulfonate-based grease composition comprises the following ingredients: overbased calcium sulfonate, overbased magnesium sulfonate, water, and optional base oil, and wherein water is the sole conventional converting agent in the pre-conversion composition. According to another preferred embodiment, a a pre-conversion sulfonate-based grease composition comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20.

The highly overbased oil-soluble calcium sulfonate (also referred to herein as simply "calcium sulfonate" or "overbased calcium sulfonate" for brevity) used according to these embodiments of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The overbased calcium sulfonate contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sulfonates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease.

The overbased calcium sulfonate used may be of a "good" quality or a "poor" quality as defined in the '406 patent and herein. Certain overbased oil-soluble calcium sulfonates marketed and sold for the manufacture of calcium sulfonate-based greases can provide products with unacceptably low dropping points when prior art calcium sulfonate technologies are used. Such overbased oil-soluble calcium sulfonates are referred to as "poor quality" overbased oil-soluble calcium sulfonates throughout this application. When all ingredients and methods are the same except for the commercially available batch of overbased calcium sulfonate used, overbased oil-soluble calcium sulfonates producing greases having higher dropping points (above 575 F) are considered to be "good" quality calcium sulfonates for purposes of this invention, and those producing greases having lower dropping points are considered to be "poor" quality for purposes of this invention. Several examples of this are provided in the '406 patent, which is incorporated by reference. Although comparative chemical analyses of good quality and poor quality overbased oil-soluble calcium sulfonates has been performed, it is believed that the precise reason for this low dropping point problem has not been proven. While many commercially available overbased calcium sulfonates are considered to be good quality, it is desirable to achieve both improved thickener yield and higher dropping points regardless of whether a good quality or a poor quality calcium sulfonate is used. It has been found that both improved thickener yield and higher dropping point may be achieved with either a good quality or a poor quality calcium sulfonate when an alkali metal hydroxide is used, particularly in combination with the delayed converting agent addition, split magnesium sulfonate addition, and delayed magnesium sulfonate addition methods according to the invention.

Any petroleum-based naphthenic or paraffinic mineral oils commonly used and well known in the grease making art may be used as the base oil according to the invention. Base oil is added as needed, since most commercial overbased calcium sulfonates will already contain about 40% base oil as a diluent so as to prevent the overbased sulfonate from being so thick that it cannot be easily handled. Similarly, overbased magnesium sulfonate will likely contain base oil as a diluent. With the amount of base oil in the overbased calcium sulfonate and overbased magnesium sulfonate, it may be unnecessary to add additional base oil depending on the desired consistency of the grease immediately after conversion as well as the desired consistency of the final grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) is preferably in the ranges indicated in Table 1 above, based on the final weight of the grease. Typically, the amount of base oil added as a separate ingredient will increase as the amount of overbased calcium sulfonate decreases. Combinations of different base oils as described above may also be used in the invention, as will be understood by those with ordinary skill in the art.

The overbased magnesium sulfonate (also referred to herein as simply "magnesium sulfonate," for brevity) used according to these embodiments of the invention for a calcium magnesium sulfonate grease can be any typical to that documented or known in the prior art. The overbased magnesium sulfonate may be made in-situ or any commercially available overbased magnesium sulfonate may be used. Overbased magnesium sulfonate will typically comprise a neutral magnesium alkylbenzene sulfonate and an amount of overbasing wherein a substantial amount of that overbasing is in the form of magnesium carbonate. The magnesium carbonate is believed to typically be in an amorphous (non-crystalline) form. There may also be a portion of the overbasing that is in the form of magnesium oxide, magnesium hydroxide, or a mixture of the oxide and hydroxide. The total base number (TBN) of the overbased magnesium sulfonates is preferably at least 400 mg KOH/gram, but lower TBN values may also be acceptable and in the same ranges as indicated for the TBN values for the overbased calcium sulfonate above.

Although not required, a small amount of a facilitating acid may optionally be added to the mixture prior to conversion according to another embodiment of the invention. Suitable facilitating acids, such as an alkyl benzene sulfonic acid, having an alkyl chain length typically between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion and preferably in an amount in the ranges indicated in Table 1. If the calcium sulfonate is made in situ using alkyl benzene sulfonic acid, the facilitating acid added according to this embodiment is in addition to that required to produce the calcium sulfonate Water is added to the preferred embodiments of the invention as one converting agent. The total amount of water added as a converting agent, based on the final weight of the grease, is preferably in the ranges indicated in Table 1. Additional water may be added after conversion. Also, if the conversion takes place in an open vessel at a sufficiently high temperature so as to volatilize a significant portion of the water during conversion, additional water may be added to replace the water that was lost. Conventional non-aqueous converting agents, which are typically added to calcium sulfonate greases, are not used as ingredients according to preferred embodiments of the invention. Such conventional non-aqueous converting agents include alcohols, ethers, glycols, glycol ethers, glycol polyethers, and other polyhydric alcohols and their derivatives. These ingredients may be added after conversion is complete, if desired, within the scope of the invention since they will not act as converting agents if added after conversion; however, it is preferred that they be omitted altogether.

One or more calcium containing bases are also added as ingredients in a preferred embodiment of a calcium magnesium sulfonate grease composition according to the invention. These calcium containing bases react with complexing acids to form a complex calcium magnesium sulfonate grease. The calcium containing bases may include calcium hydroxyapatite, added calcium carbonate, added calcium hydroxide, added calcium oxide, or a combination of one or more of the foregoing. Most preferably added calcium hydroxyapatite and added calcium carbonate are used together, along with a small amount of added calcium hydroxide. The preferred amounts of these three added calcium containing bases as ingredients by weight percent of the final grease product (although these bases will react with acids and will not be present in the final grease product) according to this preferred embodiment are:

TABLE 2

Preferred Added Calcium Containing Bases

| Ingredient | Preferred Amount (%) | More Preferred Amount (%) | Most Preferred Amount (%) |
|---|---|---|---|
| Calcium Hydroxyapatite | 1.0-20 | 2.0-15 | 3.0-10 |

TABLE 2-continued

| Preferred Added Calcium Containing Bases | | | |
|---|---|---|---|
| Ingredient | Preferred Amount (%) | More Preferred Amount (%) | Most Preferred Amount (%) |
| Added Calcium Carbonate | 1.0-20 | 2.0-15 | 3.0-10 |
| Added Calcium Hydroxide or Calcium Oxide | 0.07-1.2 | 0.15-1.00 | 0.18-0.80 |

The calcium hydroxyapatite used as a calcium containing base for reacting with complexing acids according to preferred embodiments may be added pre-conversion, post-conversion, or a portion added pre- and a portion added post-conversion. Most preferably, the calcium hydroxyapatite is finely divided with a mean particle size of around 1 to 20 microns, preferably around 1 to 10 microns, most preferably around 1 to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will preferably be in the ranges indicated in Tables 1 (total calcium containing bases) or 2, although more can be added, if desired, after conversion and all reaction with complexing acids is complete.

According to another preferred embodiment of the invention, calcium hydroxyapatite may be added in an amount that is stoichiometrically insufficient to fully react with the complexing acids. In this embodiment, finely divided calcium carbonate as an oil-insoluble, solid, added calcium-containing base may be added, preferably before conversion, in an amount sufficient to fully react with and neutralize the portion of any subsequently added complexing acids not neutralized by the calcium hydroxyapatite.

According to another preferred embodiment, calcium hydroxyapatite may be added in an amount that is stoichiometrically insufficient to fully react with the complexing acids. In this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. According to yet another preferred embodiment, when calcium hydroxyapatite is used in combination with added calcium hydroxide as calcium containing bases for reacting with complexing acids to make a calcium magnesium sulfonate grease, a smaller amount of calcium hydroxyapatite is needed compared to the greases described in the '406 patent. In the '406 patent, the added calcium hydroxide and/or calcium oxide are preferably present in an amount not more than 75% of the hydroxide equivalent basicity provided by the total of the added calcium hydroxide and/or calcium oxide and the calcium hydroxyapatite. In other words, the calcium hydroxyapatite contributes preferably at least 25% of the total added hydroxide equivalents (from both calcium hydroxyapatite and added calcium hydroxide and/or added calcium oxide) in the greases described in the '406 patent, particularly when a poor quality overbased calcium sulfonate is used. If less than that amount of calcium hydroxyapatite is used, the dropping point of the final grease may suffer. However, with the addition of overbased magnesium sulfonate to the composition according to various embodiments of this invention, less calcium hydroxyapatite may be used while still maintaining sufficiently high dropping points. The amount of calcium hydroxyapatite used according to preferred embodiments of this invention may be less than 25%, and even less than 10% of the hydroxide equivalent basicity, even when a poor quality overbased calcium sulfonate is used. This is one indication that the presence of overbased magnesium sulfonate in the finished grease has resulted in an unexpected changed and improved chemical structure not anticipated by the prior art. Since calcium hydroxyapatite is typically much more costly compared to added calcium hydroxide, this results in a further potential cost reduction for the final grease without any significant reduction in dropping point.

In another embodiment, calcium carbonate may also be added with the calcium hydroxyapatite, calcium hydroxide and/or calcium oxide, with the calcium carbonate being added either before or after reacting with complexing acids, or added both before and after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The added calcium carbonate used as a calcium containing base, either alone or in combination with another calcium containing base or bases, according to these embodiments of the invention, is finely divided with a mean particle size of around 1 to 20 microns, preferably around 1 to 10 microns, most preferably around 1 to 5 microns. Furthermore, the added calcium carbonate is preferably crystalline calcium carbonate (most preferably calcite) of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of added calcium carbonate added is preferably in the ranges indicated in Tables 1 (total calcium containing bases) or 2. These amounts are added as a separate ingredient in addition to the amount of dispersed calcium carbonate contained in the overbased calcium sulfonate. According to another preferred embodiment of the invention, the added calcium carbonate is added prior to conversion as the sole added calcium-containing base ingredient for reacting with complexing acids. Additional calcium carbonate may be added to either the simple or complex grease embodiments of the invention after conversion, and after all reaction with complexing acids is complete in the case of a complex grease. However, references to added calcium carbonate herein refer to the calcium carbonate that is added prior to conversion and as one of or the sole added calcium-containing base for reaction with complexing acids when making a complex grease according to the invention.

The added calcium hydroxide and/or added calcium oxide added pre-conversion or post-conversion according to another embodiment shall be finely divided with a mean particle size of around 1 to 20 microns, preferably around 1 to 10 microns, most preferably around 1 to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will preferably be in the ranges indicated in Tables 1 (total calcium containing bases) or 2. These amounts are added as separate ingredients in addition to the amount of residual calcium hydroxide or calcium oxide contained in the overbased calcium sulfonate. Most preferably, an excess amount of calcium hydroxide relative to the total amount of complexing acids used is not added prior to conversion. According to yet another embodiment, it is not necessary to add any calcium hydroxide or calcium oxide for reacting with complexing acids and either added calcium carbonate or calcium hydroxyapatite (or both) may be used as the sole added calcium containing base(s) for such reaction or may be used in combination for such reaction.

One or more alkali metal hydroxides are also optionally added as ingredients in a preferred embodiment of a calcium magnesium sulfonate grease composition according to the invention. The optional added alkali metal hydroxides comprise sodium hydroxide, lithium hydroxide, potassium hydroxide, or a combination thereof. Most preferably, lithium hydroxide is the alkali hydroxide used with the overbased calcium magnesium sulfonate greases according to one embodiment of the invention. In combination with the added overbased magnesium sulfonate, lithium hydroxide may work as well as, or better than, sodium hydroxide. This is unexpected since lithium hydroxide appeared not to work as well as sodium hydroxide when only overbased calcium sulfonate is used, as disclosed in the '422 application. This is yet another indication that the presence of overbased magnesium sulfonate in the final grease has resulted in an unexpected property not anticipated by the prior art. The total amount of alkali metal hydroxide added is preferably in the ranges indicated in Table 1. As with the calcium-containing bases, the alkali metal hydroxide reacts with complexing acids resulting in an alkali metal salt of a complexing acid present in the final grease product. The preferred amounts indicated above are amounts added as raw ingredients relative to the weight of the final grease product, even though no alkali metal hydroxide will be present in the final grease.

According to one preferred embodiment of a method for making an overbased calcium magnesium sulfonate grease, the alkali metal hydroxide is dissolved in the water prior to being added to other ingredients. The water used to dissolve the alkali metal hydroxide may be water used as a converting agent or water added post-conversion. It is most preferred to dissolve the alkali metal hydroxide in water prior to adding it to the other ingredients, but it may also be directly added to the other ingredients without first dissolving it in water.

One or more complexing acids, such as long chain carboxylic acids, short chain carboxylic acids, boric acid, and phosphoric acid are also added when a complex calcium magnesium sulfonate grease is desired. A preferred range of total complexing acids is around 1.25% to 18% and preferred amounts for specific types of complexing acids as ingredients by weight percent of the final grease product (although these acids will react with bases and will not be present in the final grease product) are:

TABLE 3

| Preferred Complexing Acids | | | |
|---|---|---|---|
| Ingredient | Preferred Amount (%) | More Preferred Amount (%) | Most Preferred Amount (%) |
| Short Chain Acids | 0.05-2.0 | 0.1-1.0 | 0.15-0.5 |
| Long Chain Acids | 0.5-8.0 | 1.0-5.0 | 2.0-4.0 |

TABLE 3-continued

| Preferred Complexing Acids | | | |
|---|---|---|---|
| Ingredient | Preferred Amount (%) | More Preferred Amount (%) | Most Preferred Amount (%) |
| Boric Acid | 0.3-4.0 | 0.5-3.0 | 0.6-2.0 |
| Phosphoric Acid | 0.4-4.0 | 0.6-3.0 | 0.8-2.0 |

The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid. The total amount of long chain carboxylic acid(s) is preferably in the ranges indicated in Table 3.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. The total amount of short chain carboxylic acids is preferably in the ranged indicated in Table 3. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture. Additionally, acetic acid and other carboxylic acids may be used as a converting agent or complexing acid or both, depending on when it is added. Similarly, some complexing acids (such as the 12-hydroxystearic acid in the '514 and '467 patents) may also be used as converting agents.

If boric acid is used as a complexing acid according to this embodiment, the amount is preferably in the ranges indicated in Table 3. The boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated epoxides, borated peroxides and the like may be used instead of boric acid. If phosphoric acid is used as a complexing acid, an amount preferably in the ranges indicated in Table 3 is added. The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention. All percentages of ingredients are based on the final weight of the finished grease unless otherwise indicated, even though that amount of the ingredient may not be in the final grease product due to reaction or volatilization.

The calcium sulfonate complex greases according to these preferred embodiments are an NLGI No. 2 grade grease having a dropping point of at least 575 F more preferably of 650 F or greater, but greases with other NLGI grades from No. 000 to No. 3 may also be made according to these embodiments with modifications as will be understood by those of ordinary skill in the art. The use of the preferred methods and ingredients according to the invention appear to improve high temperature shear stability compared to most calcium sulfonate-based greases (that are 100% based on calcium).

Methods of Making Sulfonate-Based Greases without a Pre-Conversion Addition of a Conventional Non-Aqueous Converting Agent The calcium magnesium sulfonate grease compositions are preferably made according to the methods of the invention described herein. In one preferred embodiment, the method comprises: (1) mixing overbased calcium sulfonate and a base oil; (2) adding and mixing overbased magnesium sulfonate, which may be added all at once prior to conversion, added using a split addition method, added using a magnesium sulfonate delay period, or added using a combination of split addition and magnesium sulfonate delay period(s); (3) optionally adding and mixing an alkali metal hydroxide, preferably pre-dissolved in water prior to adding to the other ingredients; (4) adding and mixing one or more calcium containing bases; (5) adding and mixing water as a converting agent, which may include the water from step 3 if added prior to conversion, and omitting any pre-conversion addition of conventional non-aqueous converting agents; (6) optionally adding and mixing one or more facilitating acids; (7) adding and mixing one or more complexing acids, if a complex calcium magnesium grease is desired; and (8) heating some combination of these ingredients until conversion has occurred. Additional optional steps comprises: (9) optionally mixing additional base oil, as needed, after conversion; (10) mixing and heating to a temperature sufficiently high to insure removal of water and any volatile reaction byproducts and optimize final product quality; (11) cooling the grease while adding additional base oil as needed; (12) adding remaining desired additives as are well known in the art; and, if desired, (13) milling the final grease as required to obtain a final smooth homogenous product.

The added magnesium sulfonate may be added all at once prior to conversion, preferably just after mixing the overbased calcium sulfonate and any added base oil. According to another preferred embodiment, there may be a magnesium sulfonate delay period, as further described in the '792 application and below, between the addition of water or other reactive ingredients and at least a portion of the magnesium sulfonate added prior to conversion. According to another preferred embodiment, a portion of the magnesium sulfonate may be added prior to conversion (preferably at the beginning, just after mixing the overbased calcium sulfonate and any added base oil, or prior to conversion beginning) and another portion added after conversion (either right after conversion is complete or after post-conversion heating and/or cooling of the mixture).

Each of the ingredients in steps (3), (4) and (7) can be added prior to conversion, after conversion, or a portion added prior and another portion added after conversion. Any facilitating acid added in step (6) is preferably added prior to conversion. If a facilitating acid and alkali metal hydroxide are used, the facilitating acid is preferable added to the mixture before the alkali metal hydroxide is added. Most preferably, the specific ingredients and amounts used in the methods of the invention are according to the preferred embodiments of the compositions described herein. Although some ingredients are preferably added prior to other ingredients, the order of addition of ingredients relative to other ingredients in the preferred embodiments of the invention is not critical.

Although the order and timing of these final steps 9-13 is not critical, it is preferred that water be removed quickly after conversion. Generally, the grease is heated (preferably under open conditions, not under pressure, although pressure may be used) to between 250 F and 300 F, preferably 300 F to 380 F, most preferably 380 F to 400 F, to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

Overbased Magnesium Sulfonate Delayed Addition Methods

In one preferred embodiment, there are one or more delay periods between the addition of water or other reactive ingredients (such as acids, bases, or non-aqueous converting agents) and the subsequent addition of at least a portion of the overbased magnesium sulfonate. In this magnesium sulfonate delayed addition method, one or more delays may precede the addition of all of the magnesium sulfonate or, if a split addition method is also used, one or more delay periods may precede any portion of the magnesium sulfonate added or may precede each portion added. One or more of the magnesium sulfonate delay periods may be a temperature adjustment delay period or a holding delay period or both.

For example, a first magnesium sulfonate temperature adjustment delay period is the amount of time after a portion water or other reactive ingredient is added and prior to the addition of magnesium sulfonate that it takes to heat the mixture to a temperature or range of temperatures (the first magnesium sulfonate temperature). A first magnesium sulfonate holding delay period is the amount of time the mixture is held at the first magnesium sulfonate temperature before being heated or cooled to another temperature or before adding at least a portion of the magnesium sulfonate. A second magnesium sulfonate temperature adjustment delay period is the amount of time after the first holding delay period that it takes to heat or cool the mixture to another temperature or temperature range (the second magnesium sulfonate temperature). A second magnesium sulfonate holding delay period is the amount of time the mixture is held at the second magnesium sulfonate temperature before being heated or cooled to another temperature or before adding at least another portion of magnesium sulfonate. Additional magnesium sulfonate temperature adjustment delay periods or magnesium sulfonate holding delay periods (i.e. a third magnesium sulfonate temperature adjustment delay period) follow the same pattern. Generally, the duration of each magnesium sulfonate temperature adjustment delay period will be about 30 minutes to 24 hours, or more typically about 30 minutes to 5 hours. However, the duration of any magnesium sulfonate temperature adjustment delay period will vary depending on the size of the grease batch, the equipment used to mix and heat the batch, and the temperature differential between the starting temperature and final temperature, as will be understood by those of ordinary skill in the art.

Generally, a magnesium sulfonate holding delay period will be followed or preceded by a temperature adjustment delay period and vice versa, but there may be two holding delay periods back to back or two temperature adjustment periods back to back. For example, the mixture may be held at ambient temperature for 30 minutes prior to adding a portion of magnesium sulfonate and after adding water or a reactive ingredient (a first magnesium sulfonate holding delay period) and may continue to be held at ambient temperature for another hour prior to adding more magnesium sulfonate (a second magnesium sulfonate holding delay period). Additionally, the mixture may be heated or cooled to a first temperature prior to adding at least a portion of the magnesium sulfonate and after adding water or another reactive ingredient (a first magnesium sulfonate temperature adjustment period) and then the mixture is heated or cooled to a second temperature after which more magnesium sulfonate is added (a second magnesium sulfonate temperature adjustment period, without any interim holding period). Additionally, a portion of magnesium sulfonate need not be added after every delay period, but may skip delay periods prior to addition or between additions. For example, prior to adding a portion of the magnesium sulfonate, the mixture may be heated to a temperature (first magnesium sulfonate temperature adjustment delay period) and then held at that temperature for a period of time (a first magnesium sulfonate holding delay period) before a subsequent addition of magnesium sulfonate.

According to one preferred embodiment, the first magnesium sulfonate temperature may be ambient temperature or another temperature. Any subsequent magnesium sulfonate temperature may be higher or lower than the previous temperature. If a portion of magnesium sulfonate is added to a mixture including water or other reactive ingredients immediately after the mixture reaches a temperature or range of temperatures, then there is no magnesium sulfonate holding time delay for that particular temperature and that portion of the magnesium sulfonate; but if another portion of magnesium sulfonate is added after holding at that temperature or range of temperatures for a period of time then there is a magnesium sulfonate holding time delay for that temperature and that portion of the magnesium sulfonate. A portion of magnesium sulfonate may be added after any magnesium sulfonate temperature adjustment delay period or magnesium sulfonate holding delay period and another portion of magnesium sulfonate may be added after another magnesium sulfonate temperature adjustment delay period or magnesium sulfonate holding delay period. Additionally, the addition of water, one reactive ingredient or a portion thereof may be a starting point for one magnesium sulfonate delay period and a subsequent addition of water, the same reactive ingredient, a different reactive ingredient, or portion thereof may be a starting point for another magnesium sulfonate delay period.

Overbased Magnesium Sulfonate Split Addition Methods

In another preferred embodiment, the total amount of overbased magnesium sulfonate is added in two parts (a split addition method). The first portion being added at or near the beginning of the process (before conversion is complete, and preferably before conversion begins), and the second part being added later after the grease structure has formed (after conversion is complete or after post-conversion heating and/or cooling of the mixture). When a split addition method is used, it is preferred to add around 0.1-20% magnesium sulfonate (based on the final weight of the grease) in the first part added prior to conversion, more preferably around 0.5-15%, and most preferably around 1.0-10% in the first part. The remainder of the magnesium sulfonate, preferably to provide total amounts in the ranges indicated in Table 1, would be added after conversion. Preferably around 0.25 to 95% of the total magnesium sulfonate is added in the first part, more preferably around 1.0-75% of the total magnesium sulfonate, and most preferably around 10-50% of the total magnesium sulfonate is added in the first part.

A split overbased magnesium sulfonate addition method may also be combined with a delayed magnesium sulfonate addition method. In a preferred combined method, a first portion of the overbased magnesium sulfonate is not added at the very beginning, but after the addition water or one or more reactive components, and before conversion begins—with one or more magnesium sulfonate temperature adjustment delay period and/or magnesium sulfonate holding delay periods between the addition of water or other reactive ingredients and the addition of the first portion of the magnesium sulfonate. The second portion is then added after conversion is complete either before further addition of water or additional reactive ingredient(s) (with no additional magnesium sulfonate delay periods) or after the addition of additional water or other reactive components (another magnesium sulfonate delay period, which may include one or more magnesium sulfonate temperature adjustment delay period and/or magnesium sulfonate holding delay periods).

Any of these magnesium sulfonate addition methods may be combined with any facilitating acid delay method, any calcium containing base addition method, any alkali metal hydroxide addition method, or any combination thereof described below.

Facilitating Acid Delay Methods

According to another preferred embodiment, a sulfonate-based grease compositions are preferably made with a facilitating acid delay period, as described in the '839 application. The preferred steps are the same as steps (1)-(13) above, except that the addition of a facilitating acid in step (6) is not optional and there are one or more facilitating acid delay periods between the addition of the facilitating acid(s) and at least a portion of another ingredient (the next subsequently added ingredient). The facilitating acid added in step 6 is added prior to conversion. If an alkali metal hydroxide is used, the facilitating acid is preferable added to the mixture before the alkali metal hydroxide is added.

A facilitating acid delay period may be a facilitating acid temperature adjustment delay period or a facilitating acid holding delay period. For example, a first facilitating acid temperature adjustment delay period is the amount of time after one or more facilitating acids is added and prior to the addition of the next ingredient (or portion thereof) that it takes to heat the mixture to a temperature or range of temperatures (the first facilitating acid temperature). A first facilitating acid holding delay period is the amount of time the mixture is held at the first facilitating acid temperature (which may be ambient temperature) before being heated or cooled to another temperature or before adding the next ingredient or next portion of a facilitating acid. A second facilitating acid temperature adjustment delay period is the amount of time after the first holding delay period that it takes to heat or cool the mixture to another temperature or temperature range (the second facilitating acid temperature). A second facilitating acid holding delay period is the amount of time the mixture is held at the second facilitating acid temperature before being heated or cooled to another temperature or before adding the next ingredient. Additional facilitating acid temperature adjustment delay periods or facilitating acid holding delay periods (i.e. a third facilitating acid temperature adjustment delay period) follow the same pattern. Generally, the duration of each facilitating acid temperature adjustment delay period will be about 30 minutes to 24 hours, or more typically about 30 minutes to 5 hours. However, the duration of any facilitating acid temperature adjustment delay period will vary depending on the size of the grease batch, the equipment used to mix and heat the batch, and the temperature differential between the starting temperature and final temperature, as will be understood by those of ordinary skill in the art.

Most preferably, a facilitating acid delay period occurs between the addition of a facilitating acid and the addition of magnesium sulfonate, calcium hydroxyapatite, or calcium carbonate (as the next subsequently added ingredient). Other ingredients may also serve at the next subsequently added ingredient following a facilitating acid delay. According to another preferred embodiment, water as a converting agent is not present in a mixture of other ingredients during a facilitating acid delay period. Most preferably, water is not added as the next subsequent ingredient after a facilitating acid delay period, but is added sometime after the next subsequent ingredient.

According to another preferred embodiment, a simultaneous facilitating acid delay and a magnesium sulfonate delay are used. In this embodiment, there is no magnesium sulfonate present when the facilitating acid is added to an initial mixture of overbased calcium sulfonate and base oil. The initial mixture of base oil, overbased calcium sulfonate, and facilitating acid are sufficiently mixed to allow the facilitating acid to react with the overbased calcium sulfonate prior to adding any magnesium sulfonate. After this delay period, which is both a facilitating acid delay period and a magnesium sulfonate delay period, at least a portion of the magnesium sulfonate is added. The various types and combinations of delays previously described are equally applicable in this embodiment regarding the delay or delays between the addition of the facilitating acid and the addition of the magnesium sulfonate. If the magnesium sulfonate that is added is only the first of two portions of magnesium sulfonate to be added, with the second portion being added later, then a split magnesium sulfonate addition method would also be employed, as previously discussed. Most preferably, when a facilitating acid delay and magnesium sulfonate delay are simultaneous, water is not added as a converting agent until after at least the first portion (or all) of the magnesium sulfonate is added. The importance of this specific combined use of the delayed facilitating acid method and the delayed magnesium sulfonate method is that such a combined use of these methods allows the facilitating acid to react with the calcium sulfonate, but not with the magnesium sulfonate. The delay between the addition of the facilitating acid and the first portion of the magnesium sulfonate may be 20-30 minutes, or longer. A shorter delay, such as 20 minutes, would still qualify as a true delay period herein, even without any temperature adjustment. This is because the reaction of facilitating acid with the calcium sulfonate (or magnesium sulfonate, if a portion of the magnesium sulfonate is added prior to the facilitating acid according to another preferred embodiment) will typically be very facile, and will be expected to occur rapidly upon mixing, even at normal ambient temperatures. Any intentional delay between the addition of the facilitating acid and a first portion (or all) of the magnesium sulfonate as herein described that sufficiently allows reaction of the facilitating acid with the already present calcium sulfonate qualifies as a facilitating acid delay period and a magnesium sulfonate delay period.

A short delay (20 minutes or less) for mixing without heating between the addition of the facilitating acid and calcium hydroxyapatite (or calcium carbonate) is not considered a facilitating acid holding delay period because the calcium hydroxyapatite (the next added ingredient) is considered non-reactive with the facilitating acid. If the next added ingredient were considered reactive (such a magnesium sulfonate), then a short mixing time without heating would be a facilitating acid holding delay period. Additionally, if the short mixing time of 20 minutes involved heating or was a longer mixing time, it would be considered a facilitating acid delay period regardless of which ingredient is the next added ingredient.

Methods for Adding Calcium Containing Bases

According to several preferred embodiments, the step(s) of adding one or more calcium containing base(s)) involves one of the following: (a) admixing finely divided calcium hydroxyapatite prior to conversion as the only calcium containing base added; (b) admixing finely divided calcium hydroxyapatite and calcium carbonate in an amount sufficient to fully react with and neutralize subsequently added complexing acids, according to one embodiment; (c) admixing finely divided calcium hydroxyapatite and calcium hydroxide and/or calcium oxide in an amount sufficient to fully react with and neutralize subsequently added complexing acids, with the added calcium hydroxide and/or calcium oxide preferably being present in an amount not more than 90% of the hydroxide equivalent basicity provided by the total of the added calcium hydroxide and/or calcium oxide and the calcium hydroxyapatite, according to another embodiment of the invention; (d) admixing added calcium carbonate after conversion, according to another embodiment of the invention; (e) admixing calcium hydroxyapatite after conversion and in an amount sufficient to completely react with and neutralize any complexing acids added post-conversion, according to yet another embodiment of the invention; (f) admixing finely divided calcium carbonate as an oil-insoluble solid calcium-containing base prior to conversion and admixing finely divided calcium hydroxyapatite and calcium hydroxide and/or calcium oxide in an amount insufficient to fully react with and neutralize subsequently added complexing acids, with the added calcium hydroxide and/or calcium oxide preferably being present in an amount not more than 90% of the hydroxide equivalent basicity provided by the total of the added calcium hydroxide and/or calcium oxide and the calcium hydroxyapatite, with the previously added calcium carbonate being added in an amount sufficient to fully react with and neutralize the portion of any subsequently added complexing acids not neutralized by the calcium hydroxyapatite and calcium hydroxide and/or calcium oxide.

Added Alkali Metal Hydroxide Methods

According to yet another preferred embodiment, a calcium magnesium sulfonate grease is made with added alkali metal hydroxide. The alkali metal hydroxide is preferably dissolved in water and the solution added to the other ingredients. According to other preferred embodiments, when an alkali metal hydroxide is added, one or more of the following steps are included: (a) alkali metal hydroxide is dissolved in the water to be added as a converting agent and the water with dissolved alkali metal hydroxide is added all at once prior to conversion (with additional water added later in the process to make-up for evaporative losses, as needed); (b) (i) a first portion of water is added as a converting agent prior to conversion and a second portion of water is added after conversion and (ii) the alkali metal hydroxide is dissolved in the first portion of water or the second portion of water or both; (c) water is added in at least two separate pre-conversion steps as a converting agent, with one or more temperature adjustment steps, addition of another ingredient(s) steps or a combination thereof between the first addition of water as a converting agent and the second addition of water as a converting agent, and the alkali metal hydroxide is dissolved in the initial or first addition of water as a converting agent, or the second or subsequent addition of water as a converting agent, or both; (d) at least part of the complexing acids are added prior to heating; (e) all of the complexing acid(s) are added prior to heating; (f) when added calcium carbonate is used as the added calcium containing base for reacting with complexing acids, it added before any complexing acid(s); (g) calcium hydroxyapatite, added calcium hydroxide and added calcium carbonate are all used as calcium containing bases for reacting with complexing acids; (h) the water with dissolved alkali metal hydroxide is added after the calcium containing base(s) are added and/or after a portion of the pre-conversion complexing acid(s) are added; and/or (i) the water with dissolved alkali metal hydroxide (or alkali metal hydroxide added separately) are added before adding a least a portion of one or more complexing acids. These embodiments may be combined with any calcium base addition method, the converting agent delay method, the addition of magnesium sulfonate (all at one, with a split magnesium sulfonate addition method, a magnesium sulfonate delayed method, or any combination thereof), or any combination thereof.

The preferred embodiments of the methods herein may occur in either an open or closed kettle as is commonly used for grease manufacturing. The conversion process can be achieved at normal atmospheric pressure or under pressure in a closed kettle. Manufacturing in open kettles (vessels not under pressure) is preferred since such grease manufacturing equipment is commonly available. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art. Manufacturing in pressurized kettles may also be used and may result in even greater improvement in thickener yield, but the pressurized processes may be more complicated and difficult to control. Additionally, manufacturing calcium magnesium sulfonate greases in pressurized kettles may result in productivity issues. The use of pressurized reactions can be important for certain types of greases (such as polyurea greases) and most grease plants will only have a limited number of pressurized kettles available. Using a pressurized kettle to make calcium magnesium sulfonate greases, where pressurized reactions are not as important, may limit a plant's ability to make other greases where those reactions are important. These issues are avoided with open vessels.

The overbased calcium magnesium sulfonate grease compositions without conventional non-aqueous converting agents and methods for making such compositions according to various embodiments the invention are further described and explained in relation to the following examples. The overbased calcium sulfonate used in Examples 1, 3, and 6-13 was a good quality overbased calcium sulfonate. The overbased calcium sulfonate used in all other examples was a poor quality calcium sulfonate similar to that used in Examples 10 and 11 of the '406 patent.

Example 1

(Baseline Example—Non-Aqueous Converting Agent Used) A calcium magnesium sulfonate complex grease was made based on the calcium carbonate-based calcium sulfonate grease technology of the '265 patent and the calcium magnesium sulfonate grease technology of the '792 application. The ratio of overbased calcium sulfonate to overbased magnesium sulfonate was about 90/10. A converting agent delay method, where there was a delay between the addition of water as a converting agent and the addition of a non-aqueous converting agent, as described in U.S. application Ser. No. 14/990,473 (incorporated herein by reference), was also used. All the overbased magnesium sulfonate was added at the beginning.

The grease was made as follows: 310.14 grams of 400 TBN overbased oil-soluble calcium sulfonate were added to an open mixing vessel followed by 345.89 grams of a solvent neutral group 1 paraffinic base oil having a viscosity of about 600 SUS at 100 F. The 400 TBN overbased oil-soluble calcium sulfonate was a good quality calcium. Mixing without heat began using a planetary mixing paddle. Then 31.60 grams of overbased magnesium sulfonate A was added and allowed to mix in for 15 minutes. Then 31.20 grams of a primarily C12 alkylbenzene sulfonic acid were added. After mixing for 20 minutes, 75.12 grams of finely divided calcium carbonate with a mean particle size below 5 microns were added and allowed to mix in for 20 minutes. Then 0.84 grams of glacial acetic acid and 8.18 grams of 12-hydroxystearic acid were added. The mixture was stirred for 10 minutes. Then 40.08 grams water were added, and the mixture was heated with continued mixing to a temperature of 190 F to 200 F. This represents a temperature adjustment delay. The mixture was mixed at this temperature range for 30 minutes. This represents a holding delay. During that time, significant thickening had occurred, with a grease structure having formed.

Fourier Transform Infrared (FTIR) spectroscopy indicated that water was being lost due to evaporation. Another 70 ml water were added. FTIR spectroscopy also indicated that conversion had partially occurred even though no hexylene glycol (non-aqueous converting agent) had yet been added. After the 30 minutes holding delay at 190 to 200 F, 15.76 grams of hexylene glycol (a conventional non-aqueous converting agent) were added. Shortly after this, FTIR spectroscopy indicating that the conversion of the amorphous calcium carbonate to crystalline calcium carbonate (calcite) had occurred. However, the batch seemed to soften somewhat after the glycol was added. Another 20 ml water were added followed by 2.57 grams of glacial acetic acid and 16.36 grams of 12-hydroxystearic acid. These two complexing acids were allowed to react for 10 minutes. Then 16.60 grams of a 75% solution of phosphoric acid in water were slowly added and allowed to mix in and react.

The grease was then heated to 390 to 400 F. As the mixture was heated, the grease continued to become increasingly thin and fluid. The heating mantle was removed from the mixer and the grease was allowed to cool while continuing to be mixed. The mixture was very thin and had very little if any significant grease texture. When the temperature was below 170 F, a sample was removed from the mixer and given passes through a three-roll mill. The milled grease had an unworked penetration of 189. This result was extremely surprising and indicated that a very unusual and highly rheopectic structure had formed. Three more portions of the same base oil totaling 116.02 grams were added. The grease was then removed from the mixer and given three passes through a three-roll mill to achieve a final smooth homogenous texture. The grease had a worked 60 stroke penetration of 290. The percent overbased oil-soluble calcium sulfonate in the final grease was 31.96%. The dropping point was 617 F. Before milling, this Example 1 grease had an extremely fluid texture. This very unusual property could have multiple applications where a very fluid and pumpable lubricant is needed until it is delivered to the equipment to be lubricated. If either the equipment dispensing the lubricant to the equipment or the equipment itself (or both) can adequately shear the lubricant so as to simulate milling, then a firm grease could be generated. The advantage of such a lubricant is that it would have the pumpability and mobility of a fluid but the texture of a grease in the equipment to be lubricated.

Example 2

(Baseline Example—Non-Aqueous Converting Agent Used) Another grease was made similar to the previous Example 1 grease. However, there were some differences. First, this grease used a poor quality overbased calcium sulfonate, as described in the '406 patent. Second, the overbased magnesium sulfonate was intentionally not added until the initial base oil, overbased calcium sulfonate, and facilitating acid had been added and mixed for 20 minutes without any applied heat (a simultaneous facilitating acid delay period and magnesium sulfonate delay period). Third, this grease used a 16.52 gram addition of a 75% solution of phosphoric acid in water similar to the Example 1 grease. The final milled Example 2 grease had a worked 60 stroke penetration of 293. The percent overbased oil-soluble calcium sulfonate in the final grease was 26.78%. However, the dropping point was 520 F. It should be noted that this grease had a composition that was essentially the same as the greases of Examples 6-9 of the '406 patent. Those four greases also used the same poor quality overbased calcium sulfonate. The dropping points of those four greases were 496, 483, 490, and 509; the average value was 495 F. Although the dropping point of this Example 2 grease was low, it was somewhat higher than those four greases from the '406 patent.

Example 3

A grease was made similar to the previous Example 1 grease. Like the Example 1 grease, this grease had a ratio of overbased calcium sulfonate to overbased magnesium sulfonate that was about 90/10. All the overbased magnesium sulfonate was added at the beginning along with the overbased calcium sulfonate, before the facilitating acid was added. This Example 3 grease used the same good quality overbased calcium sulfonate as the Example 1 grease. The only significant difference between this grease and the Example 1 grease was that this grease did not have any conventional non-aqueous converting agent added. Water was added as the only conventional converting agent and additional water was added as required to replace any water lost due to evaporation during the conversion process. Conversion was monitored by FTIR spectra and took 2 hours to complete. The conversion took place due only to water, the overbased magnesium sulfonate, and any effects due to the initial amounts of the pre-conversion complexing acids that were added. As the grease was heated to its top temperature, it significantly softened in a manner similar to the Example 1 grease. The grease texture was recovered upon milling, just as was observed in the Example 1 grease. This extreme rheopectic property has the same potential utility as mentioned in Example 1.

Example 4

Another grease was made similar to previous Example 3 grease. The only significant difference was that a poor quality overbased calcium sulfonate was used. Conversion was monitored by FTIR spectra and took 7 hours to complete.

Example 5

Another grease was made similar to previous Example 4 grease. The only significant difference was that only about half the amount of overbased magnesium sulfonate was used. This grease used the same poor quality overbased calcium sulfonate as was used in previous examples of this document. Conversion was monitored by FTIR spectra and took 10.5 hours to complete. A summary of the Example 3-5 greases are provided below in Table 4.

TABLE 4

Summary of Examples 3-5

| Example | 3 | 4 | 5 |
|---|---|---|---|
| % Overbased Calcium Sulfonate | 32.77 | 37.05 | 34.49 |
| % Overbased Magnesium Sulfonate | 3.47 | 3.72 | 1.68 |
| Quality of Calcium Sulfonate | Good | Poor | Poor |
| Ratio of Ca Sulfonate to Mg Sulfonate | 90/10 | 90/10 | 95/5 |
| Time to Conversion, hrs | 2 | 7 | 10.5 |
| Unworked Penetration | 280 | 289 | 267 |
| Worked Penetration | 292 | 295 | 295 |
| Dropping Point, F. | >650 | 558 | 562 |
| Four Ball EP, Weld Load, kg | 500 | 500 | ND |
| Four Ball Wear | 0.37 | 0.37 | 0.38 |

TABLE 4-continued

| Summary of Examples 3-5 | | | |
|---|---|---|---|
| Example | 3 | 4 | 5 |
| Roll Stability at 25 C., 2 hrs: | | | |
| Initial worked Penetration | 269 | 295 | 295 |
| Final Worked Penetration | 267 | 317 | 303 |
| % Change | −0.7 | 7.5 | 2.7 |
| Dropping Pt After Test, F. | 633 | 520 | 522 |
| Roll Stability at 150 C., 2 hrs: | | | |
| Initial worked Penetration | 269 | 295 | 295 |
| Final Worked Penetration | 281 | 301 | 291 |
| % Change | 4.5 | 2 | −1.4 |
| Dropping Pt After Test, F. | >650 | 583 | 574 |

Except for the omission of a conventional non-aqueous converting agent and the addition of overbased magnesium sulfonate, the Example 3-5 greases had essentially the same composition as the greases of Examples 6-9 of the '406 patent (which used hexylene glycol and water as conventional converting agents). The Example 6-9 greases of the '406 patent used the same poor quality overbased calcium sulfonate as the Example 4 and 5 greases herein. The only compositional difference was that the Example 4-5 greases contained overbased magnesium sulfonate and did not include the hexylene glycol. Although the dropping points of the Example 4 and 5 greases (which contained the poor quality overbased calcium sulfonate) were rather low, they were much improved over the Examples 6-9 greases of the '406 patent (which also contained the same poor quality overbased calcium sulfonate and had dropping points ranging from 483 F-509 F). It appears that the addition of magnesium sulfonate acts as a converting agent, so that the addition of a conventional non-aqueous converting agent is not required. The conversion process did take much longer when poor instead of good quality overbased calcium sulfonate was used. However, the beneficial effect of the overbased magnesium sulfonate on conversion was apparent by comparing the required conversion times for Example 4 and 5. When the concentration of overbased magnesium sulfonate was significantly reduced, the conversion time significantly increased. This shows that the overbased magnesium sulfonate is having a positive effect on conversion. Also, the dropping point of both Example 4 and 5 greases improved after being sheared at 150 C, as indicated by the roll stability test data. This again shows the potential beneficial effect of overbased magnesium sulfonate on improving high temperature structural stability when used at higher temperatures.

Another important observation is made by comparing the dropping point of the Example 2 grease with the Example 4 and 5 greases. All three greases were compositionally similar. They all contained the same poor quality overbased calcium sulfonate and the same overbased magnesium sulfonate. They also contained the same complexing acids added in a similar way. There was only one significant compositional difference: the Example 2 grease contained a conventional non-aqueous converting agent (hexylene glycol) whereas the Example 4 and 5 greases did not. Yet, the dropping points of the Example 4 and 5 greases were significantly higher than that of the Example 2 grease. This demonstrates that when a calcium magnesium sulfonate complex grease is made without a conventional non-aqueous converting agent, a higher dropping point is possible compared to a similar grease made with a conventional non-aqueous converting agent. This result is a surprising and unexpected benefit of using overbased magnesium sulfonates in these greases, and it was not expected based on the teachings of the prior art.

Example 6

Another grease was made similar to the previous Example 3 grease. However, a significant difference was that a facilitating acid delay method was used. Specifically, the facilitating acid was added after the initial base oil portion and the overbased calcium sulfonate was added. The facilitating acid was allowed to mix with these components for 30 minutes at ambient temperature before adding the next reactive component—the overbased magnesium sulfonate (this is a simultaneous facilitating acid delay period and magnesium sulfonate delay period as described in the '839 application). Also, a second amount of powdered calcium carbonate was added post-conversion and a higher amount of 12-hydroxystearic acid was added thereafter. Finally, this example was finished so that it was an NLGI No. 1 grade grease.

The grease was made as follows: 310.35 grams of 400 TBN overbased oil-soluble calcium sulfonate were added to an open mixing vessel followed by 345.38 grams of a solvent neutral group 1 paraffinic base oil having a viscosity of about 600 SUS at 100 F. The 400 TBN overbased oil-soluble calcium sulfonate was a good quality calcium sulfonate as defined by our recently issued U.S. Pat. No. 9,458,406. Mixing without heat began using a planetary mixing paddle. Then 31.03 grams of a primarily C12 alkylbenzene sulfonic acid were added. After mixing for 30 minutes, 31.18 grams of overbased magnesium sulfonate A was added and allowed to mix in for 15 minutes (a facilitating acid delay period and a magnesium sulfonate delay period). Then 75.25 grams of finely divided calcium carbonate with a mean particle size below 5 microns were added and allowed to mix in for 20 minutes. Then 0.87 grams of glacial acetic acid and 8.09 grams of 12-hydroxystearic acid were added. The mixture was stirred for 10 minutes. Then 40.0 grams water were added, and the mixture was heated with continued mixing to a temperature of 190 F to 200 F. As the mixture reached 181 F it was showing visible signs of thickening. After one hour and 30 minutes, FTIR spectroscopy indicated that the conversion of the amorphous calcium carbonate to crystalline calcium carbonate had occurred. During that time, two 40 ml portions of water were added to replace water lost due to evaporation. Another 25.05 grams of the same powdered calcium carbonate were added and allowed to mix for 20 minutes.

Then 1.53 grams of glacial acetic acid and 41.97 grams of 12-hydroxystearic acid were added. These two complexing acids were allowed to react for 30 minutes. Then 16.90 grams of a 75% solution of phosphoric acid in water were slowly added and allowed to mix in and react. The grease was then heated to 340 F. The grease retained its grease consistency during the heating to top temperature. The heating mantle was removed from the mixer and the grease was allowed to cool while continuing to be mixed. When the temperature was below 170 F, a sample was removed from the mixer and given three passes through a three-roll mill. The milled grease had an unworked penetration of 192. Three more portions of the same paraffinic base oil totaling 125.29 grams were added. The grease was then removed from the mixer and given three passes through a three-roll mill to achieve a final smooth homogenous texture. The grease had a worked 60 stroke penetration of 326, an NLGI No. 1 grade product. The percent overbased oil-soluble calcium sulfonate in the final grease was 30.64%. The dropping point was 619 F.

Example 7

Another grease was made similar to the previous Example 6 grease. Like the previous Examples, this calcium sulfonate complex grease was made based on the calcium carbonate-based calcium sulfonate grease technology of the '265 patent. Like the previous Example 6 grease, the ratio of overbased calcium sulfonate to overbased magnesium sulfonate was about 90/10. Also, a facilitating acid delay method was used. Specifically, the facilitating acid was added after the initial base oil portion and the overbased calcium sulfonate was added. The facilitating acid was allowed to mix with these components for 30 minutes at ambient temperature before adding the next reactive component—the overbased magnesium sulfonate. All the overbased magnesium sulfonate was added at that time. The only significant differences between this grease and the previous Example 6 grease were as follows: this grease had a higher total amount of the powdered calcium carbonate added with equal portions added before and after conversion; a higher amount of 12-hydroxystearic acid was added after conversion; powdered anhydrous calcium sulfate was added after the grease had been heated to top temperature; and the batch size was increased to allow better mixing during the early part of the batch.

The grease was made as follows: 372.10 grams of 400 TBN overbased oil-soluble calcium sulfonate were added to an open mixing vessel followed by 316.03 grams of a solvent neutral group 1 paraffinic base oil having a viscosity of about 600 SUS at 100 F. The 400 TBN overbased oil-soluble calcium sulfonate was a good quality calcium sulfonate as defined in the '406 patent. Mixing without heat began using a planetary mixing paddle. Then 37.47 grams of a primarily C12 alkylbenzene sulfonic acid were added. After mixing for 30 minutes, 37.29 grams of overbased magnesium sulfonate A (the same commercial source used in several examples described in the '792 application) was added and allowed to mix in for 15 minutes. This represents a facilitating acid delay period and a magnesium sulfonate delay period. Then 90.11 grams of finely divided calcium carbonate with a mean particle size below 5 microns were added and allowed to mix in for 20 minutes. Then 1.01 grams of glacial acetic acid and 9.25 grams of 12-hydroxystearic acid were added. The mixture was stirred for 10 minutes. Then 48.14 grams water were added, and the mixture was heated with continued mixing to a temperature of 190 F to 200 F. As the mixture reached 170 F it was showing visible signs of thickening. After one hour and 30 minutes, FTIR spectroscopy indicated that the conversion of the amorphous calcium carbonate to crystalline calcium carbonate had occurred. During that time, two 30 ml portions of water were added to replace water lost due to evaporation. Also, another 19.70 grams of the same paraffinic base oil was added due to the increasing thickness of the grease.

After conversion was considered complete, another 90.17 grams of the same powdered calcium carbonate were added and allowed to mix for 20 minutes. Then 1.88 grams of glacial acetic acid and 86.75 grams of 12-hydroxystearic acid were added. These two complexing acids were allowed to react for 30 minutes. Another 39.87 grams of the same paraffinic base oil was added. Then 19.89 grams of a 75% solution of phosphoric acid in water were slowly added and allowed to mix in and react. The grease was then heated to 340 F. The grease retained its grease consistency during the heating to top temperature. The heating mantle was removed from the mixer and the grease was allowed to cool while continuing to be mixed. When the grease had cooled to below 300 F, 60.14 grams of food grade anhydrous calcium sulfate having a mean particle size below 5 microns were added. When the temperature was below 170 F, a sample was removed from the mixer and given three passes through a three-roll mill. The milled grease had an unworked penetration of 189. Six more portions of the same paraffinic base oil totaling 244.17 grams were added. The grease was then removed from the mixer and given three passes through a three-roll mill to achieve a final smooth homogenous texture. The grease had a worked 60 stroke penetration of 256. The percent overbased oil-soluble calcium sulfonate in the final grease was 26.10%. Using the customary inverse linear relationship between worked penetration and percent overbased calcium sulfonate concentration, this example grease would have had a percent overbased calcium sulfonate concentration of 23.9% if additional base oil had been added to bring the worked penetration to a value of 280 (the center of the NLGI No. 2 grade range). The dropping point was 646 F. It should be noted that this Example 7 grease had a thickener yield that was superior to any other calcium carbonate-based calcium magnesium sulfonate complex grease described in the '792 application, where a conventional non-aqueous converting agent was used. Furthermore, this Example 7 grease had a thickener yield that was superior to any grease described in the '265 patent. This excellent thickener yield was obtained while maintaining a very high dropping point. This shows the surprising and unexpected benefit of using an overbased magnesium sulfonate without any conventional non-aqueous converting agent when making a calcium magnesium sulfonate complex greases.

A series of six grease examples were prepared to examine the ability of overbased magnesium sulfonate to act as a new, non-conventional converting agent in place of a conventional non-aqueous converting agents when making calcium magnesium sulfonate greases with added calcium hydroxyapatite as a calcium containing base for reacting with complexing acids.

Example 8

A grease similar to Example 3 grease was made. The only significant difference was that a portion of calcium hydroxyapatite was added after the initial portion of base oil, the overbased calcium and magnesium sulfonates, and the facilitating acid. None of the preferred delay methods were used in making this grease. Also, the weight/weight ratio of overbased calcium sulfonate to overbased magnesium sulfonate was about 90/10.

The grease was made as follows: 310.06 grams of 400 TBN overbased oil-soluble calcium sulfonate and 31.16 grams of overbased magnesium sulfonate A were added to an open mixing vessel followed by 345.96 grams of a solvent neutral group 1 paraffinic base oil having a viscosity of about 600 SUS at 100 F. The 400 TBN overbased oil-soluble calcium sulfonate was a good quality calcium sulfonate according to the '406 patent. Mixing without heat began using a planetary mixing paddle. Then 31.14 grams of a primarily C12 alkylbenzene sulfonic acid were added. After mixing for 20 minutes, 10.02 grams of calcium hydroxyapatite with a mean particle size below 5 microns were added and allowed to mix in for 5 minutes. Then 75.08 grams of finely divided calcium carbonate with a mean particle size below 5 microns were added and allowed to mix in for 20 minutes. Then 0.91 grams of glacial acetic acid and 8.12 grams of 12-hydroxystearic acid were added. The mixture was stirred for 10 minutes. Then 40.15 grams water (as the only conventional converting agent added) were added, and the mixture was heated with continued mixing to a temperature of 190 F to 200 F. As the mixture reached 190 F it was showing visible signs of thickening. After one hour and 40 minutes, FTIR spectroscopy indicated that the conversion of the amorphous calcium carbonate to crystalline calcium carbonate had occurred. During that time, two 20 ml portions of water were added to replace water lost due to evaporation.

Then 1.42 grams of glacial acetic acid and 17.40 grams of 12-hydroxystearic acid were added. These two complexing acids were allowed to react for 30 minutes. Then 17.07 grams of a 75% solution of phosphoric acid in water were slowly added and allowed to mix in and react. The grease was then heated to 390-400 F. The grease lost nearly all its grease consistency as it began to be heated to the top temperature. This thinned out texture was retained until the grease was milled. This is similar to the behavior observed in the both the Example 1 grease (which used a conventional non-aqueous converting agent) and the Example 3 grease (which did not use a conventional non-aqueous converting agent). The heating mantle was removed from the mixer and the grease was allowed to cool while continuing to be mixed. When the temperature was below 170 F, a sample was removed from the mixer and given three passes through a three-roll mill. The milled grease had an unworked penetration of 189. Two more portions of the same paraffinic base oil totaling 100.54 grams were added. The grease was then removed from the mixer and given three passes through a three-roll mill to achieve a final smooth homogenous texture. The grease had a worked 60 stroke penetration of 273. The percent overbased oil-soluble calcium sulfonate in the final grease was 32.68%. The dropping point was 614 F. It should be noted that in this grease, like the Example 1 and 3 greases, the magnesium sulfonate was added at the beginning prior to adding the facilitating acid. This allowed the facilitating acid to mix and react with both the calcium sulfonate and magnesium sulfonate. Interestingly, all these greases also exhibited marked thinning out as they were heated to top temperature, and they recovered their grease consistency only when milled.

Example 9

Another grease was made similar to the previous Example 8 grease. There were only two significant differences: first, the amount of calcium hydroxyapatite was essentially doubled, being increased from 10.02 grams to 20.62; second, the grease was heated to a top temperature of 340 F instead of 390-400 F. It was observed that this grease visibly converted to a grease much more quickly than the Example 8 grease. Also, this grease did not begin to thin out until it reached 330 F, and it thinned out significantly less during the rest of the process compared to the Example 8 grease. The final milled grease had a worked 60 stroke penetration of 291. The percent overbased oil-soluble calcium sulfonate in the final grease was 29.65%. The dropping point was 622 F.

Example 10

Another grease was made similar to the previous Example 9 grease. The only significant difference was that the amount of calcium hydroxyapatite was again nearly doubled, being increased from 20.62 grams to 40.12 grams. It was observed that this grease visibly converted to a grease almost as soon as it reached 190 F. Also, this grease did not thin out as much as the previous two greases when it was heated to 340 F. Although it softened somewhat, it retained a distinct grease structure. The final milled grease had a worked 60 stroke penetration of 285. The percent overbased oil-soluble calcium sulfonate in the final grease was 30.43%. The dropping point was 621 F.

Example 11

Another grease was made similar to the previous Example 10 grease. The only significant difference was that the amount of overbased magnesium sulfonate was cut in half. The weight/weight ratio of overbased calcium sulfonate to overbased magnesium sulfonate was about 95/5. It was observed that conversion to a grease took much longer for this Example compared to the previous Example. This grease required about 30 minutes of mixing at 190-200 F to visibly convert to a grease. However, this grease retained its grease structure all the way through the process of making it. The final milled grease had a worked 60 stroke penetration of 289. The percent overbased oil-soluble calcium sulfonate in the final grease was 29.69%. The dropping point was 635 F. By comparing the results of the Example 8-11 greases it appears that once again the overbased magnesium sulfonate is acting as a new, non-conventional converting agent and that the use of a conventional non-aqueous converting agent is not needed. When the magnesium sulfonate concentration was significantly reduced (Example 11 compared to Example 10) conversion took significantly longer. Also, it appears that the presence of calcium hydroxyapatite added before conversion has an effect of reducing the thinning out effect that otherwise occurs when such calcium-magnesium sulfonate greases are made.

The next two example greases explore what happens when a delayed magnesium sulfonate addition method is used in a grease that also used calcium hydroxyapatite and omitted any conventional non-aqueous converting agent.

Example 12

A grease was made similar to the previous Example 11 grease. The only significant difference was that the overbased magnesium sulfonate was not added until the unconverted mixture had been heated to 190-200 F (a magnesium sulfonate temperature adjustment delay period) and held at that temperature for 30 minutes (a magnesium sulfonate holding delay period).

The grease was made as follows: 310.09 grams of 400 TBN overbased oil-soluble calcium sulfonate was added to an open mixing vessel followed by 340.03 grams of a solvent neutral group 1 paraffinic base oil having a viscosity of about 600 SUS at 100 F. The 400 TBN overbased oil-soluble calcium sulfonate was a good quality calcium sulfonate as defined in the '406 patent. Mixing without heat began using a planetary mixing paddle. Then 31.10 grams of a primarily C12 alkylbenzene sulfonic acid were added. After mixing for 20 minutes, 40.16 grams of calcium hydroxyapatite with a mean particle size below 5 microns were added and allowed to mix in for 5 minutes. It should be noted that the 20 mixing delay without heat between the addition of a facilitating acid and the next ingredient in this example and Examples 8-11 do not constitute a facilitating acid delay method as described in the '839 application. This is because the next ingredient added after the facilitating acid is calcium hydroxyapatite, which is not significantly reactive towards the facilitating acid, as shown in the '406 patent. Then 75.23 grams of finely divided calcium carbonate with a mean particle size below 5 microns were added and allowed to mix in for 20 minutes. Then 0.89 grams of glacial acetic acid and 8.11 grams of 12-hydroxystearic acid were added. The mixture was stirred for 10 minutes. Then 40.45 grams water were added, and the mixture was heated with continued mixing to a temperature of 190 F to 200 F. The mixture was held at that temperature range for 30 minutes during which time it began to thicken to a grease. During the 30 minutes, another 40.2 grams water was added to replace water lost due to evaporation. After the 30 minutes, 16.21 grams of overbased magnesium sulfonate A was added.

After one hour, FTIR spectroscopy indicated that the conversion of the amorphous calcium carbonate to crystalline calcium carbonate had occurred. During that time, two 40 ml portions of water were added to replace water lost due to evaporation. Then 1.53 grams of glacial acetic acid and 16.41 grams of 12-hydroxystearic acid were added. These two complexing acids were allowed to react for 30 minutes. During that time another 49.50 grams of the same paraffinic base oil was added as the grease continued to thicken. Towards the end of the 30 minutes of mixing, the temperature of the grease increased to about 240 F, The heating mantle was removed and the batch was allowed to cool to 200 F. Then 17.28 grams of a 75% solution of phosphoric acid in water were slowly added and allowed to mix in and react. The grease was then heated to 340 F. The grease retained all its grease consistency during the entire heating process. The heating mantle was removed from the mixer and the grease was allowed to cool while continuing to be mixed. When the temperature was below 160 F, three more portions of the same paraffinic base oil totaling 132.07 grams were added. The grease was then removed from the mixer and given three passes through a three-roll mill to achieve a final smooth homogenous texture. The grease had a worked 60 stroke penetration of 287. The percent overbased oil-soluble calcium sulfonate in the final grease was 29.86%. The dropping point was >650 F.

Example 13

Another grease was made similar to the previous Example 12 grease. However, there were several important differences. After the initial base oil, overbased calcium sulfonate, and facilitating acid were added and mixed, heating to 190-200 F began (since the mixture was heated, this is a facilitating acid temperature adjustment delay). Only when this temperature range was reached were the calcium hydroxyapatite and powdered calcium carbonate added and allowed to mix for 30 minutes. Then the initial portions of 12-hydroxystearic acid and acetic acid were added and allowed to react in the normal expected way for 30 minutes before adding the water. Once the water was added, there was another 3 hour and 40 minute delay before adding the overbased magnesium sulfonate (a magnesium sulfonate delayed period). Since the calcium hydroxyapatite and powdered calcium carbonate would likely not react significantly with the facilitating acid (given what has been previously disclosed in the '406 patent), there would be additional facilitating acid delay holding delay periods after the facilitating acid temperature adjustment delay until the overbased magnesium sulfonate was added (as the next added ingredient that is reactive with the facilitating acid). This Example 13 grease also differed from the previous Example 12 grease in that after conversion was complete, some powdered calcium hydroxide was added. The post-conversion amount of 12-hydroxystearic acid was increased, and boric acid was added as a post-conversion complexing acid. Finally, anhydrous calcium sulfate and a small amount of an antioxidant were added as the grease was cooled down from its top temperature.

The grease was made as follows: 310.02 grams of 400 TBN overbased oil-soluble calcium sulfonate was added to an open mixing vessel followed by 345.83 grams of a solvent neutral group 1 paraffinic base oil having a viscosity of about 600 SUS at 100 F. The 400 TBN overbased oil-soluble calcium sulfonate was a good quality calcium sulfonate as defined in the '406 patent. Mixing without heat began using a planetary mixing paddle. Then 31.04 grams of a primarily C12 alkylbenzene sulfonic acid were added. The mixture was then heated to 190-200 F (a facilitating acid temperature adjustment delay period). Once this temperature range was reached, 40.23 grams of calcium hydroxyapatite with a mean particle size below 5 microns were added followed by 75.04 grams of finely divided calcium carbonate with a mean particle size below 5 microns were added and allowed to mix in for 30 minutes. Then 0.88 grams of glacial acetic acid and 8.10 grams of 12-hydroxystearic acid were added. The mixture was stirred for 30 minutes to allow reaction of the two complexing acids. Then 40.26 grams water were added, and the mixing continued at the 190-200 F temperature range. After one hour of mixing, the batch began to visibly change to a grease. The mixture was stirred for another 2 hours and 40 minutes during which time four portions of 40 ml water was added to replace water lost due to evaporation. During this time FTIR spectroscopy indicated that partial conversion of the amorphous calcium carbonate had occurred. Then 16.12 grams of overbased magnesium sulfonate A was added. This represents a 3 hour and 40 minute magnesium sulfonate delayed addition method relative to the first addition of water. It also represents a facilitating acid delay since there was a facilitating acid temperature adjustment delay and several holding delays between the facilitating acid temperature adjustment delay period and the addition of the magnesium sulfonate (the next added ingredient that is reactive with the facilitating acid).

Once the overbased magnesium sulfonate was added, FTIR spectroscopy indicated that the conversion of the amorphous calcium carbonate to crystalline calcium carbonate was completed within 30 minutes. Then 11.02 grams of food grade purity calcium hydroxide having a mean particle size below 5 microns was added and allowed to mix in for 15 minutes. Then 1.54 grams of glacial acetic acid and 31.30 grams of 12-hydroxystearic acid were added. These two complexing acids were allowed to react for 30 minutes. During that time another 46.92 grams of the same paraffinic base oil was added as the grease continued to thicken. Then 16.00 grams of boric acid mixed in 50 ml of hot water was added and allowed to mix in for 15 minutes. Then 17.50 grams of a 75% solution of phosphoric acid in water were slowly added and allowed to mix in and react. The grease was then heated to 340 F. The grease retained all its grease consistency during the entire heating process. The heating mantle was removed from the mixer and the grease was allowed to cool while continuing to be mixed. When the grease had cooled to below 300 F, 40.06 grams of food grade anhydrous calcium sulfate having a mean particle size below 5 microns were added. When the grease was cooled to 250 F, 2.21 grams of an aryl amine antioxidant were added. Once the grease was cooled to 170 F, four more additions of the same paraffinic base oil totaling 131.86 grams were added. After additional mixing, the grease was removed from the mixer and given three passes through a three-roll mill to achieve a final smooth homogenous texture. The grease had a worked 60 stroke penetration of 283. The percent overbased oil-soluble calcium sulfonate in the final grease was 27.36%. The dropping point was >650 F.

Although the examples provided herein fall primarily in the NLGI No. 1, No. 2, or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

While this invention deals primarily with greases made in open vessels, and the examples are all in open vessels, the complex calcium magnesium sulfonate grease compositions and methods may also be used in closed vessels where heating under pressure is accomplished. The use of such pressurized vessels may result in even better thickener yields than those described in the examples herein. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art.

As used herein: (1) quantities of dispersed calcium carbonate (or amorphous calcium carbonate) or residual calcium oxide or calcium hydroxide contained in the overbased calcium sulfonate are by weight of the overbased calcium sulfonate; (2) some ingredients are added in two or more separate portions and each portion may be described as a percentage of the total amount for that ingredient or a percentage of final grease by weight; and (3) all other amounts (including total amounts) of ingredients identified by percentages or parts are the amounts added as an ingredient by weight of the final grease product, even though the particular ingredient (such as water, or calcium-containing bases or alkali metal hydroxides that react with other ingredients) may not be present in the final grease or may not be present in the final grease in the quantity identified for addition as an ingredient. As used herein "added calcium carbonate" means crystalline calcium carbonate that is added as a separate ingredient in addition to the amount of dispersed calcium carbonate contained in the overbased calcium sulfonate. As used herein "added calcium hydroxide" and "added calcium oxide" means calcium hydroxide and calcium oxide, respectively, which are added as a separate ingredient in addition to the amount of residual calcium hydroxide and/or calcium oxide that may be contained in the overbased calcium sulfonate. As used herein to describe the invention (as opposed to how the term is used in some prior art references), calcium hydroxyapatite means (1) the compound having the formula $Ca_5(PO_4)_3OH$ or (2) a mathematically equivalent formula (a) having a melting point of around 1100 C or (b) specifically excluding mixtures of tricalcium phosphate and calcium hydroxide by such equivalent formula.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. In like manner, as used herein the "dropping point" of a grease shall refer to the value obtained by using the standard dropping point test ASTM D2265 as commonly used in lubricating grease manufacturing. Four Ball EP tests as described herein shall refer to ASTM D2596. Four Ball Wear tests as described herein shall refer to ASTM D2266. Cone Oil Separation tests as described herein shall refer to ASTM D6184. Roll Stability tests as described herein shall refer to ASTM D1831. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

I claim:

1. A method of making a sulfonate-based grease comprising:

adding and mixing an amount of overbased calcium sulfonate containing amorphous calcium carbonate dispersed therein, an amount of overbased magnesium sulfonate, an optional amount of base oil, and water to form a pre-conversion mixture;

converting the pre-conversion mixture to a converted mixture by heating until conversion of the amorphous calcium carbonate to crystalline calcium carbonate has occurred; and wherein no conventional non-aqueous converting agents are added to the pre-conversion mixture.

2. The method of claim 1 wherein the amount of overbased calcium sulfonate is 10-45% and the amount of overbased magnesium sulfonate is 0.1-30%.

3. The method of claim 1 wherein the amount of overbased calcium sulfonate is 10-36% and the amount of overbased magnesium sulfonate is 1-24%.

4. The method of claim 1 wherein a first portion of the magnesium sulfonate is added to the pre-conversion mixture and a second portion of the magnesium sulfonate is added to the converted mixture.

5. The method of claim 4 wherein 0.25-95% of the total amount of magnesium sulfonate is added as the first portion.

6. The method of claim 4 wherein 1-75% of the total amount of magnesium sulfonate is added as the first portion.

7. The method of claim 4 wherein the first and second portions of magnesium sulfonate combined are 0.2-30% by weight of the final grease and the first portion of magnesium sulfonate is 0.1-20% by weight of the final grease.

8. The method of claim 4 wherein the first and second portions of magnesium sulfonate combined are 0.1-30% by weight of the final grease and the first portion of magnesium sulfonate is 0.5-15% by weight of the final grease.

9. The method of claim 4 wherein the converted mixture is heated to a temperature in excess of 300 F and then cooled to a temperature below 250 F and wherein the second portion of magnesium sulfonate is added after the converted mixture is cooled to a temperature below 250 F.

10. The method of claim 1 further comprising adding and mixing one or more calcium containing bases with the pre-conversion mixture, the converted mixture, or both;

adding and mixing one or more acids with the pre-conversion mixture, the converted mixture, or both;

wherein there is one or more magnesium sulfonate delay periods between the addition of water, one of the calcium containing bases, one of the acids, or any portion thereof and the addition of at least a portion of the overbased magnesium sulfonate.

11. The method of claim 10 wherein at least one of the magnesium sulfonate delay periods is a holding delay period wherein a mixture comprising water, one or more of the calcium containing bases, one or more of the acids, or any portion thereof is maintained at a temperature or within a range of temperatures for a period of time prior to adding at least a portion of the magnesium sulfonate; or wherein at least one of the magnesium sulfonate delay periods is a temperature adjustment delay period wherein a mixture comprising water, one or more of the calcium containing bases, one or more of the acids, or any portion thereof is heated or cooled prior to adding at least a portion of the magnesium sulfonate.

12. The method of claim 10 wherein one of the acids is a facilitating acid added to the pre-conversion mixture and there is at least one magnesium sulfonate delay period between the addition of the facilitating acid and at least a portion of the magnesium sulfonate.

13. The method of claim 10 wherein a first portion of the magnesium sulfonate is added to the pre-conversion mixture and a second portion of the magnesium sulfonate is added to the converted mixture;

and wherein there is a magnesium sulfonate delay period prior to the addition of the first portion of the magnesium sulfonate, the second portion of the magnesium sulfonate, or both.

14. The method of claim 10 wherein the calcium containing bases are calcium hydroxyapatite, added calcium carbonate, added calcium hydroxide, added calcium oxide or a combination thereof.

15. The method of claim 10 further comprising adding and mixing an alkali metal hydroxide with the pre-conversion mixture, the converted mixture, or both.

16. The method of claim 1 further comprising adding calcium hydroxyapatite, added calcium carbonate, added calcium hydroxide, added calcium oxide or a combination thereof to the pre-conversion mixture, the converted mixture, or both.

17. The method of claim 16 wherein the total amount of calcium hydroxyapatite, added calcium carbonate, added calcium hydroxide, added calcium oxide or a combination thereof added is 2.7-41.2%.

18. The method of claim 1 further comprising adding and mixing one or more complexing acids in a total amount of 1.25-18%.

19. The method of claim 1 wherein the overbased calcium sulfonate is a poor quality overbased calcium sulfonate.

20. A sulfonate-based grease composition comprising the following ingredients: overbased calcium sulfonate, overbased magnesium sulfonate, water, and an optional base oil; and wherein water is the sole conventional converting agent.

21. The sulfonate-based grease composition according to claim 20 further comprising one or more of the following ingredients: one or more calcium containing bases, one or more complexing acids, one or more facilitating acids, or an alkali metal hydroxide.

22. The sulfonate-based grease composition according to claim 21 wherein amount of overbased calcium sulfonate is around 1.5 to 100 times the amount of overbased magnesium sulfonate.

23. The sulfonate-based grease composition according to claim 20 wherein the amount of overbased calcium sulfonate is 10-45% and the amount of overbased magnesium sulfonate is 0.1-30%.

24. The sulfonate-based grease composition according to claim 20 wherein the amount of overbased calcium sulfonate is 10-36% and the amount of overbased magnesium sulfonate is 1-24%.

25. The sulfonate-based grease composition according to claim 21 wherein the calcium containing bases are calcium hydroxyapatite, added calcium carbonate, added calcium oxide, added calcium hydroxide, or a combination thereof and wherein the total amount of calcium containing bases is 2.7-41.2%.

26. The sulfonate-based grease composition according to 25 wherein the amount of alkali metal hydroxide is 0.005-0.5%.

27. The sulfonate-based grease composition according to 25 wherein the total amount of one or more complexing acids is 1.25-18%.

28. A pre-conversion sulfonate-based grease composition comprising the following ingredients: overbased calcium sulfonate, overbased magnesium sulfonate, water, and an optional base oil; and wherein water is the sole conventional converting agent.

29. The pre-conversion sulfonate-based grease composition according to claim 28 wherein the composition comprises a ratio of overbased calcium sulfonate to overbased magnesium sulfonate on a weight basis of around 100:1 to 60:40.

30. The pre-conversion sulfonate-based grease composition according to claim 28 the composition comprises a ratio of overbased calcium sulfonate to overbased magnesium sulfonate on a weight basis of around 90:10 to 70:30.

31. The method of claim 1 further comprising adding and mixing a facilitating acid with the pre-conversion mixture and wherein there is one or more facilitating acid delay periods between the addition of the facilitating acid and at least a portion of any subsequently added ingredient; and wherein the one or more facilitating acid delay periods comprise:

a facilitating acid holding delay period where the initial mixture is held at a temperature or range of temperatures for a period of time of 20 minutes or more between adding the facilitating acid and the subsequent addition of at least a portion of another ingredient, or a facilitating acid temperature adjustment delay period where the initial mixture is heated or cooled to a temperature or range of temperatures after adding the facilitating acid and prior to the subsequent addition of at least a portion of another ingredient, or a combination thereof.

32. The method of claim 31 wherein there is at least one facilitating acid temperature adjustment delay period where the pre-conversion mixture is heated to a temperature range of 190-200 F after adding the facilitating acid and prior to the subsequent addition of at least a portion of another ingredient.

33. The method of claim 31 wherein there is at least one facilitating acid holding delay period where the pre-conversion mixture is held at a temperature range of 190-200 F for around 20-30 minutes prior to the subsequent addition of at least a portion of another ingredient.

34. The method of claim 31 wherein the facilitating acid holding delay period is 20 minutes or more if the next added ingredient is reactive with the facilitating acid.

35. The method of claim 31 wherein the facilitating acid holding delay period is 30 minutes or more.

* * * * *